United States Patent [19]

Barbee, Jr.

[11] Patent Number: 4,484,625

[45] Date of Patent: Nov. 27, 1984

[54] WELL CASING PERFORATED ZONE WASHING APPARATUS

[75] Inventor: John P. Barbee, Jr., New Orleans, La.

[73] Assignee: The Western Company of North America, Fort Worth, Tex.

[21] Appl. No.: 370,056

[22] Filed: Apr. 20, 1982

[51] Int. Cl.[3] ..... E21B 37/00

[52] U.S. Cl. ..... 166/185; 166/312; 166/191; 166/196

[58] Field of Search ..... 166/124, 127, 128, 146, 166/147, 148, 151, 152, 186, 187, 191, 311, 312, 383

[56] References Cited

U.S. PATENT DOCUMENTS

| | | | |
|---|---|---|---|
| 2,675,876 | 4/1954 | Conrad et al. | 166/127 |
| 3,035,639 | 5/1962 | Brown et al. | 166/151 |
| 3,333,459 | 8/1967 | Claycomb . | |
| 4,279,306 | 7/1981 | Weitz | 166/187 |

*Primary Examiner*—Stephen J. Novosad
*Assistant Examiner*—William P. Neuder
*Attorney, Agent, or Firm*—Richards, Harris & Medlock

[57] ABSTRACT

A tool (20) for washing the perforated zone of a well casing in an oil or gas well includes a tubular mandrel (24) having a flow passage (26) with means for connecting one end of the mandrel to a drill string (160) and the second end to a flow blocking valve (162). The mandrel (24) has a plurality of apertures (42) through its sidewall. A first and second radially expandable packer (64, 132) completely encircles and is carried on the mandrel at spaced positions. An outer sleeve (100) surrounds the mandrel between the packers and defines an annular chamber (116) between the sleeve and mandrel. The sleeve has apertures (104) therethrough having a combined area less than the combined area of the apertures (42) through the mandrel. First and second annular pistons (74, 100) are carried within the annular chamber (116) having one face communicating with the annular chamber and an opposite face engaging, respectively, the first and second packers. Upon injection of fluid under pressure into the tubular mandrel and the annular chamber and through the apertures in the sleeve to the exterior of the tool, pressure generated within the annular chamber moves the pistons against the packers, radially expanding them against the casing while discharging fluid exteriorly of the tool.

11 Claims, 5 Drawing Figures

FIG. 3
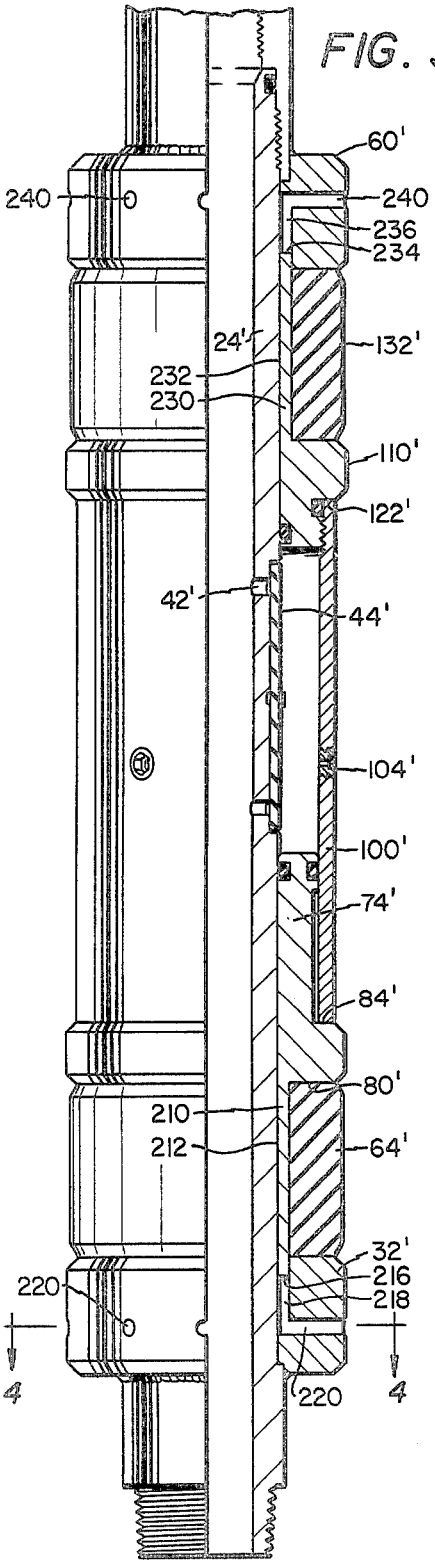
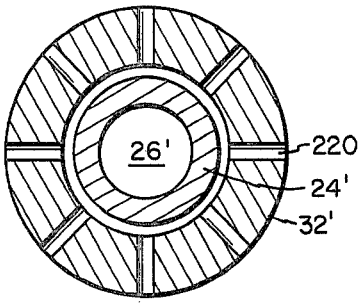
FIG. 4
FIG. 5
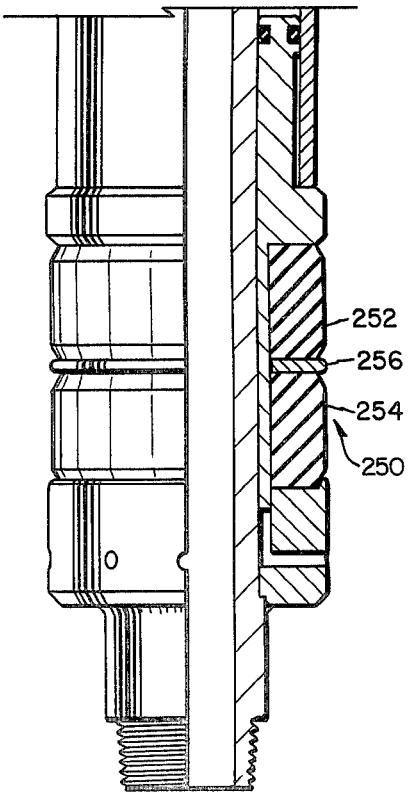

WELL CASING PERFORATED ZONE WASHING APPARATUS

TECHNICAL FIELD

The present invention relates to an apparatus and method for washing the perforated zone of a well casing in an oil or gas well. More particularly, the invention discloses a tool used to locate and seal an area adjacent perforations in a well casing and to inject a washing fluid into the casing and through the perforations in the casing to wash the zone adjacent the perforations.

BACKGROUND ART

Subsequent to the drilling of an oil or gas well, it is common to install a production casing and to perforate the casing in the area of the formation from which production of oil or gas is to be extracted. At times, either prior to the extraction of oil or gas from the formation through the perforation zone or subsequent to a period of oil or gas production, it may become beneficial or, indeed, necessary to stimulate the flow of oil or gas from the formation. Stimulation may be required as a result of a blockage which has occurred in a portion or all of the perforations in the casing or as a result of the natural decline in production as a result of the extraction of oil or gas from the formation. It is desirable to have the capability of directing the stimulation fluid, which may be water, steam or an acid solution, through selected casing perforations.

In the past, this has been accomplished by using tools having spaced packers which seal off below and above the perforations through which the appropriate work over fluid is to be injected. Then, a fluid under pressure is ejected out of the tool and into the casing area which has been packed off, thereby directing the fluid out of the casing through selected perforations.

Prior art devices have been generally of two types. One type has used cup type packers incorporating seals which are biased outwardly against the casing wall during all movement of the tool in the casing. As can be appreciated, this type of tool introduces additional wear and the possibility of damage to the packers in view of the continuous contact of the packers with the casing wall. Additionally, other operations, such as the use of the tool during clean out of the bottom of the well, are made more difficult in that fluid injected between the tool and the well casing is restricted by the packers.

A more recently developed washing tool incorporates packers which are expanded after the tool is in place. Subsequent to expansion of the packers, the cleaning or fracturing fluid is then discharged from the tool through the perforations isolated between the packers. While this device has some advantages over the prior cup type packer tools, the tool is unnecessarily complicated as a result of valving which controls the sequences of packing off the section of the casing prior to ejection of fluid into the perforation zone of the casing.

DISCLOSURE OF THE INVENTION

The present invention provides a method and apparatus for washing the perforated zone of a well casing of an oil or gas well which eliminates many of the deficiencies found in the cup type washing tools and the hydraulically actuated washing tools. The tool of the present invention includes a tubular mandrel having a flow passage therethrough and an outer diameter permitting insertion of the mandrel into the well casing. Structure is provided for connecting the first end of the mandrel to a pipe string extending from the surface of the well. A flow blocking means is attached to the mandrel on the end opposite its attachment to the pipe string and operates to block the flow of fluid from the pipe string from passing through the flow passageway of the mandrel.

First and second radially expandable packer assemblies are carried on the mandrel at spaced positions. An outer sleeve surrounds the mandrel between the packer assemblies and defines an annular chamber between the sleeve and mandrel. First and second annular pistons are carried within the annular chamber and have one face communicating with the annular chamber and an opposite face engaging, respectively, the first and second packer assemblies. These pistons are movable against the packer assemblies upon pressurization of the annular chamber.

First port means in the mandrel provides fluid communication between the flow passage in the tubular mandrel and the annular chamber. Second port means in the outer sleeve provides fluid communication between the annular chamber and the exterior of the sleeve. The second port means includes an opening of lesser area than that of the first port means.

In the use of the tool, the tool is positioned in the well casing adjacent the casing perforations into which cleaning or other fluids, such as fracturing or acidizing fluids, are to be injected. The fluid is injected under pressure to the tool through the pipe string which communicates with the flow passage of the mandrel of the tool. The fluid is prevented from flowing through the flow passage by the flow blocking means attached to one end of the mandrel.

The fluid is directed through the first port means into the annular chamber between the mandrel and the outer sleeve. Flow out of the annular chamber is restricted or choked by the second port means which has an area less than the area of the first port means. This flow restriction causes a pressure drop with the pressure within the annular chamber being applied against the faces of the first and second annular pistons within the annular chamber. The pressure within the annular chamber causes the annular pistons to move in opposed directions and against the packer assemblies. The packer assemblies are compressed and expand radially until they have engaged the inside wall of the well casing to seal off the area between the packer assemblies.

Fluid ejected from the tool through the second port means is then directed through the casing perforations either into the formation or is returned into the casing through perforations above the tool and then to the surface of the well. This circulating flow acts to clean out the area adjacent the perforated zone of the well casing for subsequent production or other operations.

In accordance with a further embodiment of the invention, a flexible sleeve is mounted around and closely conforms to the exterior of the mandrel. The sleeve is positioned to cover each of the apertures in the mandrel and permits flow of fluid from the mandrel into the annular chamber. However, upon reverse circulation for removing sand and other material from the bottom of the well hole, the flexible sleeve prevents fluid from passing into the annular chamber and through the apertures in the mandrel. The sleeve is attached to the mandrel at one point along its length, either intermediate of the apertures in the mandrel or to one side thereof.

In accordance with a further aspect of the invention, the packer assemblies include annular resilient packer bushings which are trapped between an annular flange extending from the mandrel and the annular pistons. One of the annular flanges is removable from the mandrel to permit breakdown of the tool and replacement of the packer assemblies as required.

At times, it will be necessary to pack off the present tool in an unperforated area of the well casing either below or above the perforated zone. This is done where the perforated zone is to be located by packing off the tool and moving the tool either upwardly or downwardly to locate the perforated zone. When one of the packing assemblies moves over a casing perforation, the flow of fluid will indicate to the operator that the perforated zone has been reached.

A modification of the present tool has been found to be beneficial in packing off the device in unperforated casing. In this embodiment of the invention, a sleeve extends from each of the annular pistons from the face opposite that communicating with the annular chamber. The sleeves have an end surface opposite their attachment to the piston and a port communicates between this end surface and externally of the mandrel on the side of the packer assemblies opposite the pistons. In this arrangement, low pressure is seen by the end of the sleeves rather than the high pressure which would otherwise be transmitted through the packing assemblies against the face of the pistons opposite the annular chamber. This has the effect of providing an additional outward resulting force on the pistons, permitting the packing off of the tool in unperforated casing.

The sleeves may be designed to closely fit around the mandrel and beneath the packer assemblies. In the preferred embodiment, the ports include an annular space in which the sleeves may translate with a plurality of radial holes communicating between the distal ends of the annular ports and externally of the tool.

BRIEF DESCRIPTION OF THE DRAWINGS

For a more complete understanding of the present invention and for further details and advantages thereof, reference is now made to the following description taken in conjunction with the accompanying drawings, in which:

FIG. 3 is a quarter section view of an alternative embodiment of the tool of the present invention;

FIG. 4 is a section view taken along line 4—4 of FIG. 3; and

FIG. 5 is a quarter section view of one end of the tool showing an alternative packing assembly for the present invention.

DETAILED DESCRIPTION

Figure 1:
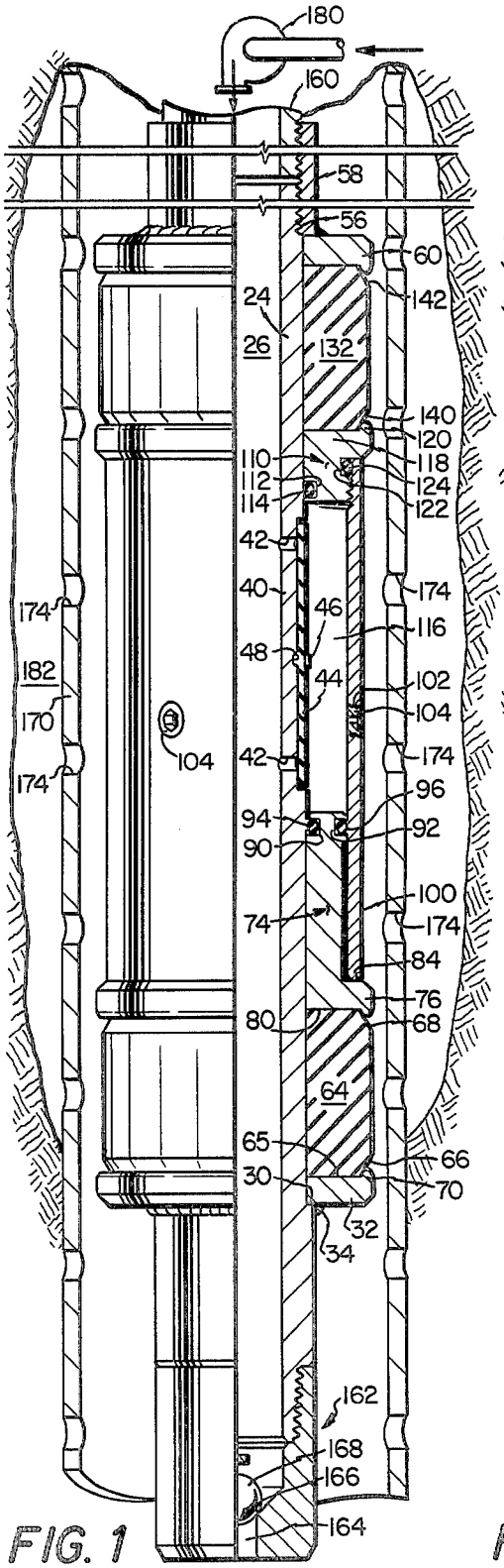
FIG. 1 is a sectional elevation of an oil well containing a perforated casing showing the tool of the present invention in quarter section and mounted on the end of the well pipe string, the tool shown in the unset or running position.

Referring to FIG. 1, tool 20 includes a tubular mandrel 24 defining a flow passage 26; the lower end of tubular mandrel has threads 28 formed on the external surface to define a pin end. The portion of the mandrel immediately above threads 28 has an enlarged thickness, the top of which defines a step 30. A lower packing seating flange 32 is positioned over mandrel 24 and against step 30. A weld 34 is used to join packing seating flange 32 to mandrel 24 as shown. The wall thickness of mandrel 24 is reduced along an intermediate section 40. In this region, a plurality of apertures through the sidewall of mandrel 24 are circumferentially spaced about the mandrel. A flexible sleeve 44 is mounted over the reduced thickness section 40 and therefore overlies apertures 42. An appropriate circumferential band or clamp 46 is placed over flexible sleeve 44 as shown to maintain the sleeve in position.

Clamp 46 is positioned around flexible sleeve 44 over an annular groove 48 formed in mandrel 24. This provides additional attachment of the flexible sleeve 44 to the mandrel. Sleeve 44 has a thickness substantially corresponding to the difference between the thickness of mandrel 24 at section 40 and the areas adjacent thereto such that the outer boundary of flexible sleeve 44 does not extend radially beyond the outer wall of mandrel 24 adjacent thereto.

The upper end of mandrel 24 has threads 56 on the outer surface thereof and receives an upper internally threaded collar 58. A packing seating flange 60 is welded to the lower end of collar 58 and may thus be longitudinally positioned by advancing or withdrawing collar 58 relative to threads 56 on mandrel 24.

An annular packing 64 is received around mandrel 24 and is seated on the upper surface 65 of packing seating flange 32. As can be seen in FIG. 1, packing seating flange 32 has an upwardly extending annular bead 70. The lower outer edge of packing 64 has a lower chamfer 66 which permits the nesting of the lower end of packing 64 onto packing seating flange 32. Similarly, the upper end of packing 64 has a chamfer 68. An annular piston 74 is received around tubular mandrel 24 and has a lower end having an outstanding portion 76 with a downwardly extending raised annular bead 78. This structure defines a downwardly facing surface 80 which engages the upper surface of packing 64. Outstanding portion 76 of piston 74 defines a ledge 84. The upper end of piston 74 has an internal and external seal receiving groove 90 and 92, respectively, for receiving an O-ring 94 and 96, respectively, therein. An outer sleeve 100 is positioned with its lower end around the upstanding portion of piston 74. The lower face of sleeve 100 engages ledge 84 of piston 74 as shown. O-ring 94 forms a seal between mandrel 24 and piston 74, while O-ring 96 forms a seal between piston 74 and outer sleeve 100.

In one embodiment of the invention, outer sleeve 100 has a plurality of tapped apertures 102 through the sidewall and circumferentially spaced around the sleeve. In the primary embodiment of the invention, six tapped apertures are provided and each is fitted with a 5/64th orifice fitting 104.

The upper end of sleeve 100 is threaded internally with threads 106 which engage the external threads 108 of upper annular piston 110. Piston 110 circumferentially surrounds mandrel 24 and has an annular groove on the interior surface for receiving an O-ring 114 to form a seal between piston 110 and mandrel 24. As can be seen in FIG. 1, an annular chamber 116 is formed between outer sleeve 100 and mandrel 24 with pistons 74 and 110 defining the lower and upper boundaries.

On its upper end, piston 110 has an outstanding portion 118 having an upwardly protruding circumferential bead 120. Outstanding portion 118 defines a downwardly facing ledge 122 and upon threaded assembly of piston 110 with sleeve 100, an appropriate seal, such as O-ring 124, is trapped between the upper end of sleeve 100 and piston 110 adjacent ledge 122.

The upwardly facing surface of piston 110 defines a surface 130. An annular packing 132 is positioned around mandrel 24 and between piston 110 and packing seating flange 60. Packing seating flange 60 has a downwardly facing surface 134 with a circumferential bead 136 extending downwardly therefrom. Packing seating flange 32 is chamfered at the lower outer edge at 140 and at the upper outer edge 142. The upper and lower ends of packing seating flange 32 are engaged by downwardly facing surface 134 of seating flange 60 and upwardly facing surface 130 of piston 110, respectively.

In utilizing tool 20 in circulating operations, the tool is attached to the end of a drill string 160 at collar 58. Using threads to the lower pin end of tool 20, a ball sub 162 having an opening 164 therethrough is attached to the tool. Sub 162 has a ball seat 166 which receives a bridging ball 168 as will be described hereinafter in greater detail.

The drill string 160 with the hydraulic injection tool 20 at its end, but without ball 168 within ball sub 162, is lowered within a pipe casing 170. Casing 170 has a plurality of perforations 172, both positioned circumferentially and at various longitudinal positions along the casing in the production zone of the well. Preferably, the injection tool 20 is lowered to a position below the highest perforation 174 as is shown in FIG. 1. Of course, the diameter of tool 20 in its unpressurized condition is sufficiently smaller than the diameter of the casing to allow it to be moved freely within the casing.

When the tool 20 has been positioned at the desired level, bridging ball 168 is dropped into the drill string and pumped down to seat 166 using pump 180. With bridging ball 168 seated in seat 166, flow of fluid through tool 20 and out of ball sub 162 is prevented. Continued pumping of fluid into flow passage 26 of tool 20 results in the flow of fluid through apertures 42 in the sidewall of mandrel 24 and into the annular chamber 116. Although sleeve 44 overlies apertures 42, the sleeve is sufficiently flexible to permit the free movement of fluid from flow passage 26 through apertures 42 and into annular chamber 116. Reverse flow, however, from annular chamber 116 into flow passage 26 through apertures 42 is prevented as will be described hereinafter in greater detail.

Continued pumping causes the flow of fluid out of annular chamber 116, and through the 5/64th orifice fittings 104. While apertures 42 are sufficiently large, on the order of ⅛th inch slots or larger, little or no pressure drop results between flow passage 26 and annular chamber 116. However, orifice fittings 104 are sufficiently small to cause a flow restriction and generate a pressure drop and thus provide a pressure buildup within annular chamber 116. At a pump rate of 42 gallons per minute, a pressure of approximately 438 psi is generated within annular chamber 116 using six 5/64th orifices in sleeve 100 as shown.

In the primary embodiment of the invention, the faces of pistons 74 and 110 defining the upper and lower surfaces of annular chamber 116 are approximately ten square inches. Thus, a pack off force of 4380 pounds is exerted by the fluid on pistons 74 and 110. This force causes the relative movement of piston 74 away from piston 110. The outward movement of pistons 74 and 110 with the immobility of fixed packing seating flanges 32 and 60 results in the compression and radial expansion of packings 64 and 132. This compression and radial expansion continues until the packings contact and seal against the interior of casing 170. To assist in this radial expansion, apertures 150 and 154 through the sidewall of mandrel 24 further communicate pressure from flow passage 26 to the area immediately beneath packings 64 and 132. This pressure further assists in the ballooning out or expansion of packings 64 and 132 to assure a seal between the packing and the casing interior surface. This results in the injection tool 20 being seated opposite the desired level of perforations and once packing off has been achieved, that portion of the casing intermediate of the contact of the packings with the casing interior surface are sealed off. With this portion of the casing sealed off, fluid ejected from the tool through orifice fittings 104 is forced through the perforations intermediate of the packings 64 and 132. This fluid is then directed into the production zone 182, and up past the desired level of perforations and into the casing 170 through upper level perforations 174. This flow results in the cleaning of the perforations 172, as well as the area immediately outside the casing, thereby resulting in a washing of the production zone immediately adjacent to the casing.

After completion of the job at this level, injection tool 20 can then be moved to another level, either above or below, by controlling the pressure at pump 180. By decreasing the pressure sufficiently, the pressure within annular chamber 116 is reduced to permit the retraction of packings 64 and 132. Upon retraction of packings 64 and 132, the device may then be moved vertically to another position, or removed from the well casing entirely.

The present invention also permits the back flushing of the well to clean out the well bottom. In this procedure, fluid is injected between the annulus of the well string and well casing and past the tool, which is in the unpressurized position. The fluid flows to the bottom of the well and then into the tool through ball sub 162. Flow upwardly through ball sub 162 is permitted in that the bridging ball 168 is raised from its seat 166 in this reverse flow situation. Fluid is continued to be pumped upwardly through the tool 20 and drill string to the surface of the well. Such flow carries with it debris and other foreign material from the bottom of the well.

Flexible sleeve 44 prevents the flow of fluid which may communicate through orifice fittings 104 into the annular chamber 116 from flowing directly into mandrel 24. Because of the overlying position of flexible sleeve 44 over apertures 42 in mandrel 24, pressure within annular chamber 116, as a result of fluid entering orifice fittings 104, seals off apertures 42 preventing the flow in this direction.

In many instances, the present tool will be used to locate the perforated zone of a well casing. This is accomplished by packing off the tool in an unperforated zone and moving the tool either upwardly or downwardly until the perforated zone is encountered. The flow of fluid through the drill string and out of the mandrel will indicate that the perforated zone has been located. FIGS. 3 and 4 illustrate an alternative embodiment of the present invention which facilitates packing off of the present tool in blank or unperforated casing.

Figure 2:
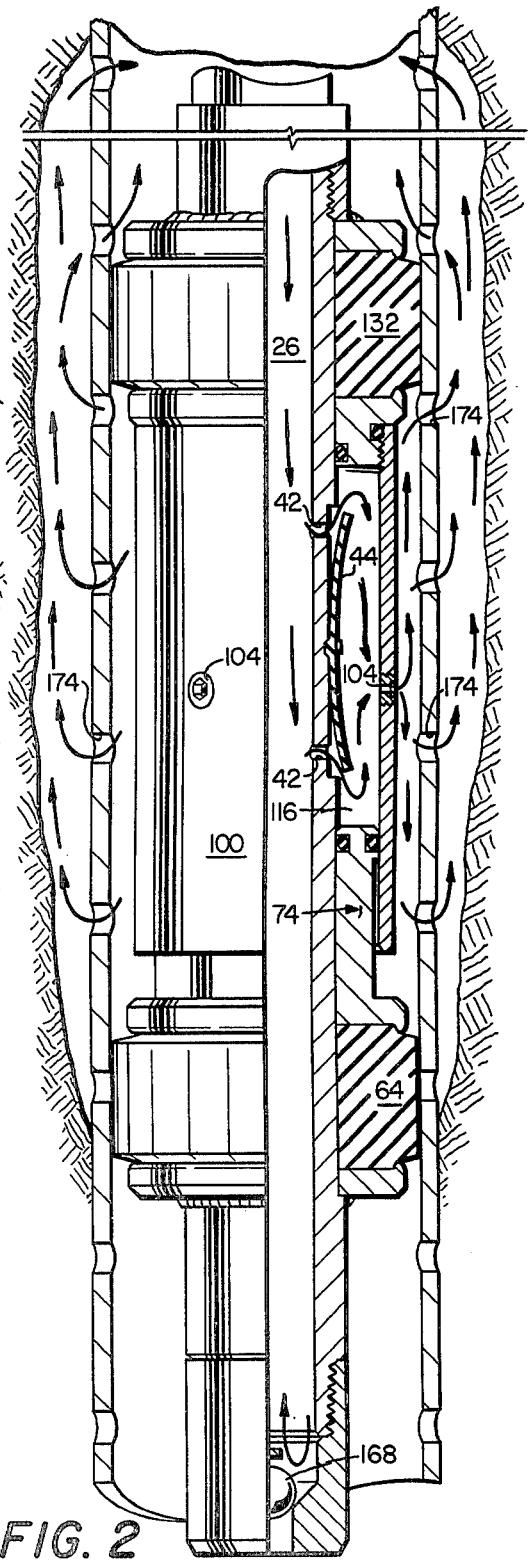
FIG. 2 is a sectional elevation similar to FIG. 1 but showing the tool in its set position with fluid being injected through the tool and casing perforations.

The structure of tool 20' illustrated in FIGS. 3 and 4 is similar to that of tool 20 illustrated in FIGS. 1 and 2 with the exceptions of the additional structure hereinafter described. Elements in tool 20' are numbered using the same numbers as used on corresponding components in tool 20 with the addition of a prime (') to differentiate between the two tools.

In tool 20', a sleeve 210 is attached to and extends from the face 80' of piston 74'. Sleeve 210 has a sliding surface 212 which confronts the exterior surface of tubular mandrel 24'. Sleeve 210 is positioned under packing 64'.

The end of sleeve 210 remote from piston 74' has an annular face 216. The end nests within an annular chamber 218 defined within a lower packing seating flange 32'. A plurality of radial ports 220 is formed in seating flange 32' and provides communication between the lower end of annular chamber 218 and the exterior of flange 32'. As will be noted, ports 220 communicate outside tool 20' on the low pressure side of packing 64'.

Referring still to FIGS. 3 and 4, a sleeve 230 is attached to and extends upwardly from face 130' of piston 110'. Sleeve 230 is positioned beneath packing 132' and has a sliding wall 232 which confronts the outer wall of tubular mandrel 24'. An upwardly directed annular face 234 is formed on the upper end of sleeve 230 and the upper end of sleeve 230 nests within an annular chamber 236 formed within upper packing seating flange 60'. A plurality of radial holes 240 is formed in upper seating flange 60' and communicates between the upper end of annular chamber 236 and the exterior of tool 20'. Apertures 240 communicate to the exterior of tool 20' on the low pressure side of packing 132'.

The embodiment illustrated in FIGS. 3 and 4 permits the packing off of the tool in blank or unperforated casing. Being able to pack off in blank casing permits the tool to be used to locate the perforated zone. As is well known in the industry, even though the location of the perforation zone is known, due to the inaccuracy of measurements, it may be necessary to pack off the tool either below or above the perforated zone and then move the tool to the zone. When the tool locates in the perforated zone, the commencement of flow of fluid through the tool indicates that the tool is adjacent the casing perforations.

With the tool 20' in blank casing, fluid pumped into mandrel 24' passes through apertures 42' past flexible sleeve 44' and into annular chamber 116'. The flow of fluid from annular chamber 116' is restricted by orifices in fitting 104', creating a pressure within annular chamber 116'. This in turn results in the outward movement of pistons 74' and 110' to compress packings 64' and 132', respectively, between the pistons and seating flanges 32' and 60', respectively. In the embodiment where sleeves 210 and 230 and the associated communication ports to the low pressure side of the packings are not provided, as the packing elements move against the casing to the point where the area between the packing and the casing is equal to or less than the orifices in fittings 104, the pressure drop across fittings 104 is lost, preventing complete pack off. However, using the design of FIGS. 3 and 4, the end face 216 of sleeve 210 and face 234 of sleeve 230 act in chambers 218 and 236, respectively, which are communicated to the low pressure side of packings 64' and 132'.

For example, the low pressure felt by end faces 216 and 234 of sleeves 210 and 230, respectively, would see a hydrostatic pressure on the order of 2500 psi in a well 5,000 feet deep. For pack off, the pressure within annular chamber 116' would be on the order of 438 psi, where a pump rate of 1 barrel/minute is generated through fittings 104'. This pressure within chamber 116', acting on a ten square inch piston area, will result in the outward movement of pistons 74' and 110' to compress the packings to the point of engagement with the casing wall. Pressure will be transmitted to faces 80' and 130' of pistons 74' and 110', respectively, as well as on ledge 84' and ledge 122' by way of sleeve 100'. It will be appreciated that a larger outwardly directed resultant force on pistons 74' and 110' will result where the end surfaces 216 and 234 of sleeves 210 and 230 communicate to the low pressure area outside of the packings.

Thus, the design shown in FIGS. 3 and 4 provides a unit which may be packed off in blank casing. Once packing off has been completed, then the tool may be raised or lowered by sliding within the casing to locate the perforated zone.

FIG. 5 shows an alternative packer assembly 250 which is substituted for packers 64' and 132' shown in the embodiments of FIGS. 3 and 4. Packer assembly 250 includes two packers 252 and 254 separated by a spacer 256. Pack off is accomplished when either packing 252 or 254 is compressed sufficiently to extend radially to full contact with the casing wall.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A tool for washing the perforated zone of a well casing in an oil or gas well comprising:

a tubular mandrel having a flow passage therethrough with means for connecting one end of the mandrel to the well drill string and the second end of the mandrel to a flow blocking valve for preventing the flow of fluid from the flow passage of said mandrel out of said second end, said mandrel having a predetermined number of apertures therethrough and no more, first and second radially expandable seal means completely encircling and carried on said mandrel at spaced positions thereon, an outer sleeve surrounding said mandrel between said seal means defining an annular chamber between said sleeve and mandrel, said sleeve having a predetermined number of apertures therethrough, and no more, of a combined total area less than the combined area of the predetermined apertures through said mandrel, valve means comprising a first and second annular piston carried within said annular chamber having one face communicating with the annular chamber and an opposite face engaging, respectively, said first and second seal means, said pistons being movable against said seal means upon pressurization of said annular chamber to radially expand said seal means against said casing, and means for injecting a fluid under pressure into the flow passage of said tubular mandrel whereby said fluid is discharged into said annular chamber and through the predetermined number of apertures in said sleeve to the exterior of said tool, creating a pressure within said annular chamber to move said pistons against said seal means, thereby radially expanding said seal means against said casing while discharging fluid exteriorly of said tool.

2. The tool according to claim 1 further comprising:

a flexible sleeve carried around and closely conforming to the exterior of said mandrel and positioned within said outer sleeve, said flexible sleeve covering each of said apertures in said mandrel and permitting flow of fluid from said mandrel into said annular chamber but blocking flow from the annular chamber into said mandrel.

3. The tool according to claim 2 wherein said sleeve is attached to said mandrel at one point along its length.

4. The tool according to claim 1 wherein each of said seal means includes an annular resilient packer bushing trapped between an annular flange extending from said mandrel and said pistons.

5. The tool according to claim 4 wherein one of said annular flanges is removably attached to said mandrel and wherein said packer bushings are removable from said mandrel by removal of said annular flange.

6. The tool according to claim 1 further comprising a first sleeve extending from said first piston on the face opposite that communicating with the annular chamber, said first sleeve having an end surface, and a port communicating between said first sleeve end surface and externally of the mandrel on the low pressure side of the first seal means.

7. The tool according to claim 6 wherein said sleeve extends around said mandrel.

8. The tool according to claim 6 wherein said first sleeve extends beneath said first seal means.

9. The tool according to claim 6 further comprising:

a second sleeve extending from said second piston on the face opposite that communicating with the annular chamber, said second sleeve having an end surface, and a port communicating between said second sleeve end surface and externally of the mandrel on the low pressure side of the second seal means.

10. A tool for washing the perforated zone of a well casing in an oil or gas well comprising:

a tubular mandrel having a flow passage therethrough and an outer body diameter permitting insertion of the mandrel into the casing, connection means for connecting the first end of said mandrel to a pipe string extending from the surface of the well, a flow blocking means attached to the second end of said mandrel for blocking the flow of fluid from the pipe string through the flow passageway of said mandrel, first and second radially expandable packer assemblies carried on said mandrel at spaced positions along said mandrel, an outer sleeve surrounding said mandrel between said packer assemblies defining an annular chamber between said sleeve and mandrel, first and second annular pistons carried within said annular chamber having one face communicating with the annular chamber and an opposite face engaging, respectively, said first and second packer assemblies, said pistons being movable against the packer assemblies upon pressurization of said annular chamber to radially expand said packer assemblies, first port means in said mandrel providing fluid communication between the flow passage in said tubular mandrel and the annular chamber, second port means in said outer sleeve providing fluid communication between said annular chamber and exterior of said sleeve, said second port means providing an opening of lesser area than said first port means such that upon injecting a fluid under pressure into the flow passage of said mandrel, said fluid is discharged into said annular chamber and out of said second port means, creating a pressure within said annular chamber to move said pistons against said packing assemblies and radially expand said assemblies against said casing while discharging fluid through said second port means externally of said tool, a first sleeve extending from said first piston on the face opposite that communicating with the annular chamber, said first sleeve having an end surface, and a port communicating between said first sleeve end surface and externally of the mandrel on the side of the first packer assembly opposite the first piston, said port comprising an annular chamber in which said sleeve moves as said first piston moves and a plurality of holes communicating between said annular chamber and externally of the mandrel.

11. A tool for washing the perforated zone of a well casing in an oil or gas well comprising:

a tubular mandrel having a flow passage therethrough with means for connecting one end of the mandrel to the well drill string and the second end of the mandrel to a flow blocking valve for preventing the flow of fluid from the flow passage of said mandrel out of said second end, said mandrel having apertures therethrough, first and second radially expandable seal means completely encircling and carried on said mandrel at spaced positions thereon, an outer sleeve surrounding said mandrel between said seal means defining an annular chamber between said sleeve and mandrel, said sleeve having apertures therethrough of a combined total area less than the combined area of the apertures through said mandrel, valve means comprising a first and second annular piston carried within said annular chamber having one face communicating with the annular chamber and an opposite face engaging, respectively, said first and second seal means, said pistons being movable against said seal means upon pressurization of said annular chamber to radially expand said seal means against said casing, means for injecting a fluid under pressure into the flow passage of said tubular mandrel whereby said fluid is discharged into said annular chamber and through the apertures in said sleeve to the exterior of said tool, creating a pressure within said annular chamber to move said pistons against said seal means, thereby radially expanding said seal means against said casing while discharging fluid exteriorly of said tool, a first sleeve extending from said first piston on the face opposite that communicating with the annular chamber, said first sleeve having an end surface, and a port communicating between said first sleeve end surface and externally of the mandrel on the low pressure side of the first seal means, said port comprising an annular chamber in which said sleeve moves as said first piston moves and a plurality of holes communicating between said annular chamber and externally of the mandrel.

* * * * *